United States Patent [19]

Nelson

[11] Patent Number: 5,000,765

[45] Date of Patent: Mar. 19, 1991

[54] CONDENSATE INHIBITING OUTLET PIPE FOR WATER-STEAM SEPARATOR

[75] Inventor: Kirk A. Nelson, Minneapolis, Minn.

[73] Assignee: Dri-Steem Humidifier Company, Eden Prairie, Minn.

[21] Appl. No.: 395,759

[22] Filed: Aug. 18, 1989

[51] Int. Cl.[5] ..... B01D 19/00

[52] U.S. Cl. ..... 55/203; 55/1; 55/399; 55/410

[58] Field of Search ..... 55/39, 204, 399, 410, 55/171-177, 459.1, 52, 191, 203, 201, 1

[56] References Cited

U.S. PATENT DOCUMENTS

| | | | |
|---|---|---|---|
| 2,899,014 | 8/1959 | Sinex | 55/174 X |
| 3,009,537 | 11/1961 | Glasgow et al. | 55/174 X |
| 3,371,469 | 3/1968 | Murdock | 55/175 |
| 3,724,180 | 4/1973 | Morton et al. | 55/410 |
| 4,097,358 | 6/1978 | Wiseman | 55/204 X |
| 4,509,965 | 4/1985 | Morton | 55/399 |

*Primary Examiner*—Charles Hart

*Attorney, Agent, or Firm*—Merchant, Gould, Smith, Edell, Welter & Schmidt

[57] ABSTRACT

A water-steam separator is used in conjunction with a steam humidifier system to maintain the relative humidity within a desired range in buildings. The separator includes a container, a vapor inlet supply pipe, and an outlet steam distribution pipe. One portion of the outlet steam distribution pipe extends outwardly from the container and has apertures therein for distributing dry steam. Another portion of the outlet steam distribution pipe extends inwardly toward the center of the container and has an opening spaced inwardly from the container wall to reduce condensates entering the outlet pipe.

3 Claims, 1 Drawing Sheet

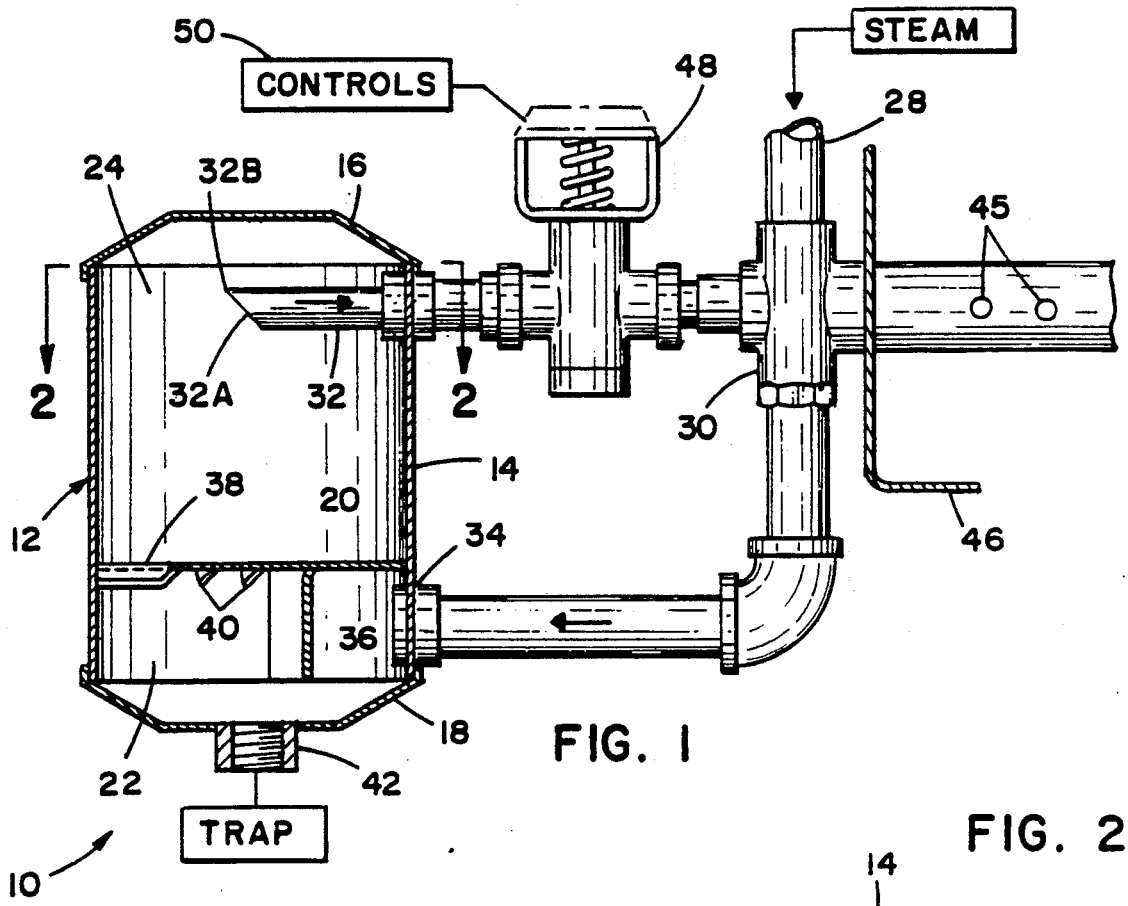
FIG. 1
FIG. 2
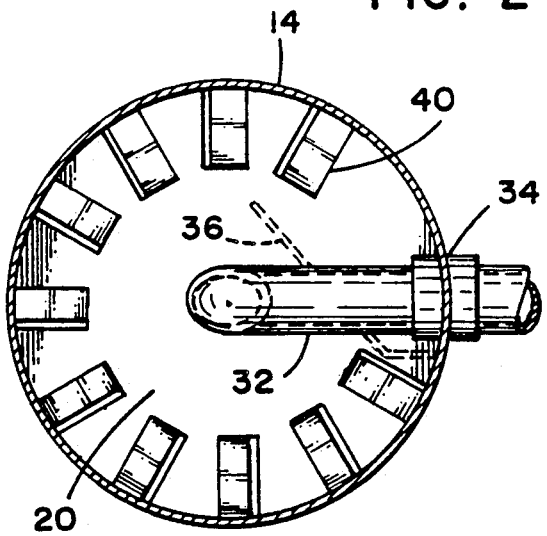
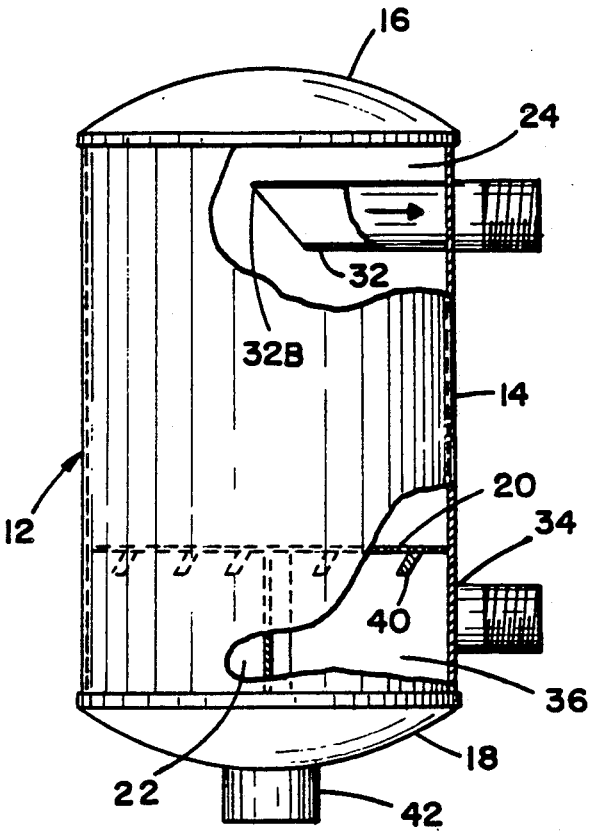
FIG. 3

CONDENSATE INHIBITING OUTLET PIPE FOR WATER-STEAM SEPARATOR

BACKGROUND OF THE INVENTION

1. Field of the Invention

This invention relates generally to an apparatus which separates water from steam in a steam humidifier system, and more particularly, to an outlet steam distribution pipe of a water-steam separator which reduces the amount of condensates entering the pipe.

2. Description of the Prior Art

Various types of water steam separators have been advanced over the years. U.S. Pat. Nos. 4,509,965 and 3,724,180 each show a water-steam separator having a container, a vapor inlet supply pipe, and an outlet steam distribution pipe. The outlet steam distribution pipes, in both cases, are merely attached to a container wall and do not extend into the interior of the container. The inlet to these outlet steam distribution pipes is adjacent the wall of the container, thus allowing condensates which form on the container wall near the opening and condensates which are suspended in the surrounding air to enter the outlet pipe. Additionally, in the forms of the prior art shown, a flow diverter causes vapor entering the container to move in an annular pattern around the interior periphery of the container, wherein the heavier condensates tend to remain at the periphery of the container and the dry steam tends to rise upward in the center of the container, thus making an inlet for the outlet steam distribution pipe at a center location desirable.

SUMMARY OF THE INVENTION

This invention is used to more efficiently separate water from steam in a water-steam separator having a container, a vapor inlet supply pipe, and an outlet steam distribution pipe. This configuration of a water-steam separator reduces the condensates entering the outlet steam distribution pipe by having a portion of the pipe which extends inwardly from a wall of the container toward the center of the container and an opening in the pipe that is spaced inwardly from that wall.

BRIEF DESCRIPTION OF THE DRAWINGS

FIG. 1 is a side view of a water-steam separator system and a cross-sectional side view of the container;

FIG. 2 is a cross-sectional view of the water-steam separator taken along line 2—2 in FIG. 1; and FIG. 3 is a side view of the water-steam separator showing the preferred embodiment of the outlet steam distribution pipe in cutaway.

DETAILED DESCRIPTION OF THE PREFERRED EMBODIMENTS

FIG. 1 shows the preferred embodiment of the present invention. The water steam separator 10 as shown in FIG. 1 includes a closed container 12 having a cylindrical wall 14, a top cover 16, and a bottom wall 18. A horizontal partition 20 is sealed along the peripheral edges of the container 12 to form a lower chamber 22 and an upper chamber 24.

Wet steam enters an inlet supply pipe 28 from a steam source indicated at 26 and flows through a jacket pipe 30 which directs the flow around an outlet steam distribution pipe 32 to keep outgoing steam the same temperature as incoming steam. The steam flows into the lower inlet chamber 22 of container 12 through an inlet opening 34 where the inlet supply pipe 28 is connected to the cylindrical wall 14 of container 12.

A vertical flow diverter wall 36 is connected to the interior of cylindrical wall 14 adjacent the steam inlet 34 and is angled so that steam coming into the container 12 through inlet 34 will be deflected to move in an annular pattern around the interior periphery of the container 12. The partition 20 has a plurality of radial openings 38 at the outer peripheral edges thereof which are defined by adjacent deflector tabs 40 that extend out of the plane of partition 20 and into the lower chamber 22. The tabs 40 are partial punch-out pieces bent downwardly so that steam moving around the interior periphery of container 12 in the lower chamber 22 is deflected downwardly. In order to go into the upper chamber 24, the steam has to change direction and flow around the deflector tabs 40 and up through the partition openings 38. Some of the heavier condensates thus separate from the steam, fall to the bottom wall 18 which slopes from its outer periphery to its center, and exit through a drain pipe 42 which is coupled to the center of bottom wall 18.

The steam that enters the upper chamber 24 still has some condensates which accumulate on the interior of the cylindrical wall 14. Because the outlet steam distribution pipe 32 of this invention extends inwardly to the center of container 12 away from cylindrical wall 14, these condensates are prevented from entering the pipe. In addition, condensates accumulate on the interior of top cover 16 and are suspended in air above the pipe. To prevent at least some of these condensates from falling into the outlet steam distribution pipe 32, the pipe has an end surface defining an inlet opening to the outlet stream distribution pipe 32 which is given a bevel end cut along a plane 32A at an acute angle from the top to the bottom to form an overhang 32B. Drier steam thus enters the outlet steam distribution pipe 32 and flows out of a plurality of openings 45 therein into an air duct 46 or similar air distribution system. The flow of steam through the entire water-steam separator system is controlled by valve 48 operated by suitable controls 50 that turn on and shut off the steam so that an adequate supply is maintained.

Although the present invention has been described with reference to preferred embodiments, workers skilled in the art will recognize that changes may be made in form and detail without departing from the spirit and scope of the invention.

What is claimed is:

1. An apparatus for separating water from steam, comprising:

a container having an outer wall, said container having a space defined therein by an inner surface of said outer wall;

a steam inlet supply pipe connected to said container so as to be in communication with said space; and an outlet steam pipe having a first portion which extends through said outer wall of said container into said space, said first portion having an end surface defining an inlet opening to said outlet steam pipe, said end surface being spaced from said inner surface of said container, whereby condensed water on said inner surface of said container is prevented from entering said inlet opening.

2. The apparatus of claim 1, wherein said outlet stream pipe extends inwardly from said outer wall to substantially the center of said container.

3. The apparatus of claim 1, wherein said end surface is beveled at an acute angle from a top of said outlet steam pipe to the bottom of said outlet steam pipe to create an overhang, thus facilitating the flow of dry steam at the center of said container into said outlet steam pipe and inhibiting condensates from falling into said outlet steam pipe.

* * * * *